US007104508B1

(12) United States Patent
Delaware

(10) Patent No.: US 7,104,508 B1
(45) Date of Patent: Sep. 12, 2006

(54) SPRING LOADED THROW ROD

(75) Inventor: Loren Delaware, Albuquerque, NM (US)

(73) Assignee: BNSF Railway Company, Austin, TX (US)

( * ) Notice: Subject to any disclaimer, the term of this patent is extended or adjusted under 35 U.S.C. 154(b) by 0 days.

(21) Appl. No.: 10/829,553

(22) Filed: Apr. 22, 2004

(51) Int. Cl.
*E01B 7/00* (2006.01)

(52) U.S. Cl. ..... 246/452; 246/415 R

(58) Field of Classification Search ..... 246/449, 246/450, 452, 448, 404; 213/46 R, 46, 78; 267/72, 75, 69, 70; 280/292; 188/69
See application file for complete search history.

(56) References Cited

U.S. PATENT DOCUMENTS 919,871 A * 4/1909 Ingram ..... 246/321
1,480,678 A * 1/1924 Feucht ..... 213/46 R
2,421,822 A * 6/1947 Wood ..... 248/543
2,772,844 A * 12/1956 McGowan ..... 246/452

* cited by examiner

*Primary Examiner*—Mark T. Le
(74) *Attorney, Agent, or Firm*—Thompson & Knight LLP; James J. Murphy

(57) ABSTRACT

A rail switch is provided having an improved throw rod to enable testing with damaging the switch. The throw rod includes a housing on its length, with a piston and spring located within the housing. A locking pin locks movement of the piston during normal operation, causing the throw rod to act as a solid rod as previously used in the art. The locking pin can be removed during gap testing, to enable a small amount of play in the length of the rod. This eliminates the stress caused on the switch by testing.

10 Claims, 2 Drawing Sheets

SPRING LOADED THROW ROD

BACKGROUND OF THE INVENTION

1. Field of the Invention

The present invention relates generally to switching equipment for railroads, and more particularly to an improved throw rod for track switches.

2. Description of the Prior Art

Since the very early days of railroads, switches have been used on tracks to move trains from one track to another. The switch can be moved by either a hand operated device, or a power switch machine.

The point of the switch includes two rail tips that are physically moved from side to side to enable the switching to occur. This movement is performed by a throw rod connected to the tips, and to the switching mechanism.

In order to insure the integrity of the signal system, and to meet Federal Railroad Administration regulations, it is necessary to regularly inspect and test the point area. This involves having a Signalman test operating of the signal with gaps made with gauges having widths of ¼ and ⅜ inch. Gaps are forced between the rails using the gauges, and operation of the signals observed.

Forcing this gap between the rails places great strain on the switch mechanism. The mechanism is designed to have great strength, and in the case of power switches is able to crush small gravel that works into the space between the rails and force the rails together. However, the additional forces generated by the forcing of gaps between the rails when in a fully thrown position can cause bending of various parts, and other problems that adversely affect operation of the switch.

It would be desirable to provide an improved switch design that allows for testing that does not adversely affect the normal operation of the switch, and that does not cause damage to the switch when performed.

SUMMARY OF THE INVENTION

In accordance with the present invention, an improved throw rod, which is used to throw the rail switch points, was developed, allowing the use of a spring buffer, to assist maintenance personnel in adjusting the tolerance on the power switch machine throw rod. The improved throw rod, can than be converted, by placing a pin in the spring basket(neutral compressed state), converting the spring loaded throw rod to a solid rod, which provides enhanced performance of the power switch. The improved throw rod includes a housing on its length, with a piston and spring located within the housing. A locking pin locks movement of the piston during normal operation, causing the throw rod to act as a solid rod as previously used in the art. The locking pin can be removed during gap testing, to enable a small amount of play in the length of the rod. This eliminates the stress caused on the switch by testing.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DESCRIPTION OF THE PREFERRED EMBODIMENT

Figure 1:
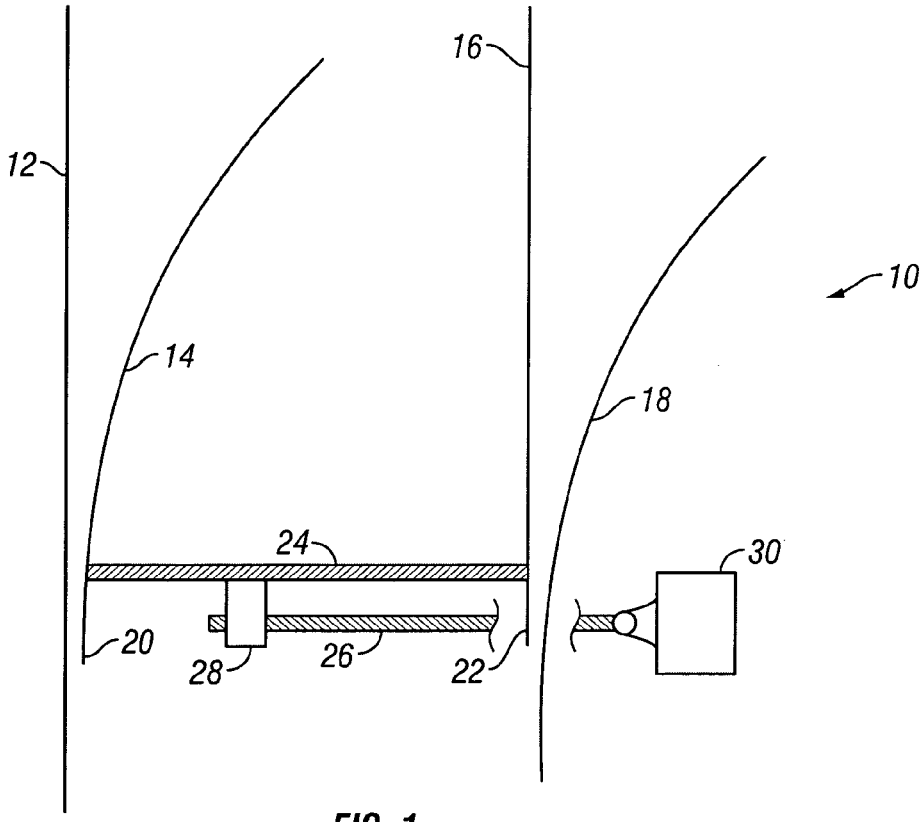
FIG. 1 (Prior Art)
FIG. 1 is a schematic illustration of a switch.

FIG. 1 illustrates a standard track switch 10. Switch 10 includes rails 12, 14, 16, and 18. In this switch, rails 12 and 16 define a first track, and rails 14 and 18 define a second track. Rail 14 has a tip 20, while rail 16 has a point 22.

Switching occurs in the following manner. Rail tips 20 and 22 are connected by a connector arm 24 that maintains the desired spacing between the tips 20, 22. A throw rod 26 is connected to connector arm 24 through a basket 28. Switch machine 30, which can be manual or machine powered, drives throw rod 26 along its length to operate the switch 10. Driving throw rod 26 to the left as shown in FIG. 1 causes the second track to be connected, while driving throw rod 26 to the right disconnects the second track from the first track.

When gaps must be forced between the rail tips 20, 22 and their adjacent tracks 12 and 18, respectively, tremendous stresses can be experienced in the connector arm 24, basket 28, throw rod 26, and switch machine 30, as well as in the tracks themselves. The improved throw rod described herein eliminates unnecessary stresses otherwise encountered during such gap testing.

Figure 2:
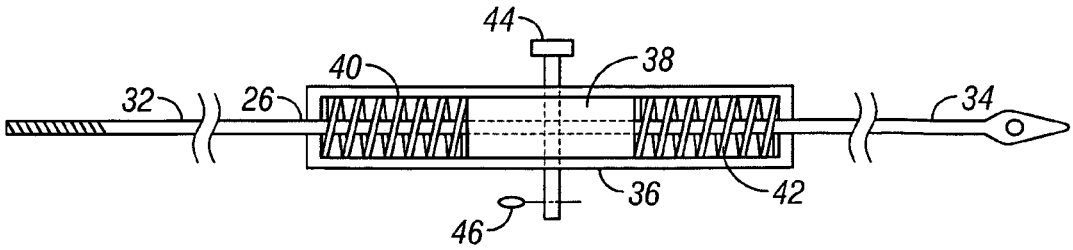
FIG. 2 is a cross section of an improved throw rod in accordance with the present invention.

FIG. 2 is a cross section of an improved throw rod in accordance with the present invention. Throw rod 26 includes a first rod portion having a connector end 32 adapted to be connected to the basket 28, and a second rod portion having a connector end adapted 34 to be connected to the switch machine 30 as known in the art. Instead of being a solid rod, however, throw rod 26 includes a cylinder 36 connected to the second rod portion, and a piston 38 connected to the first rod portion as shown. If desired, the connections of the cylinder and piston can be switched without a change in operating.

Within cylinder 36 are two springs 40, 42 that limit movement of piston 38 within cylinder 36. Pin 44 projects through the walls of cylinder 36 and through piston 38 to lock piston 38 in a fixed position. Pin 44 can be removed by removing cotter pin 46, allowing the piston 38 to move within cylinder 36. Springs 40 and 42 are preferably chosen to provide a force of approximately 2000 lbs., or another force that allows piston 38 to move slightly when the forces used to generate the gaps needed for testing are created.

During normal operation of the switch, that is at all times except when testing is being performed, pin 44 is placed in position as shown. This prevents movement of piston 38 within cylinder 36, and causes throw rod 26 to operate as a normal, solid rod. So long as pin 44 does not shear from the forces applied, rod 26 will maintain a constant length. If pin 44 does shear during operation, allowing piston 38 to move relative to cylinder 36, a problem has generally occurred within the switch. Shearing of pin 44 may prevent damage to other parts of the switch in such event, and can be easily replaced once the problem has been repaired.

During testing, pin 44 is removed. Gaps are caused adjacent rail tips 20, 22 as known in the art, and movement of piston 38 within cylinder 36 prevents unwanted forces from being applied to the switch. Once testing is completed, the switch is operated to return the piston 38 to a neutral position, and pin 44 reinserted.

Figure 3:
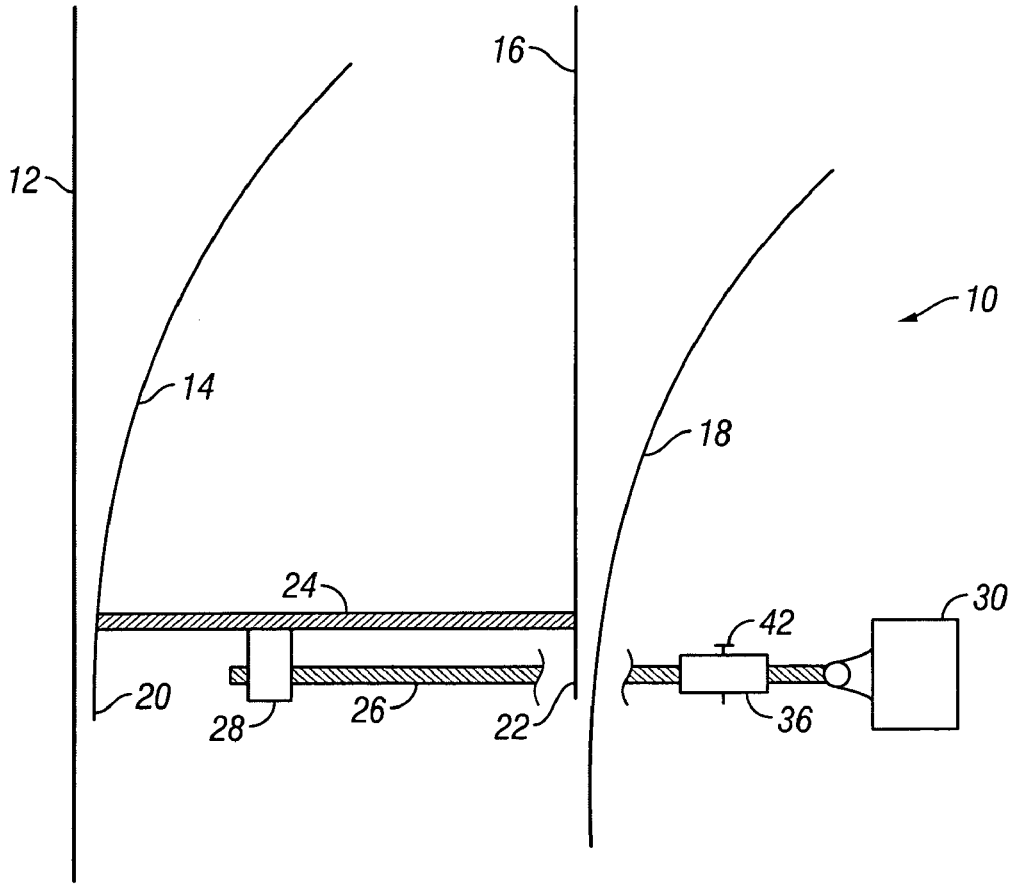
FIG. 3 is a schematic diagram of the improved throw rod included with the switch.

Referring to FIG. 3, in a preferred embodiment cylinder 36 is located on throw rod 26 outside the tracks and near the switching machine 30. However, it will be appreciated by those skilled in the art that cylinder 36 can be located at any convenient location along the length of throw rod 26, so long as it lies between switch machine 30 and basket 28. The goal is to ensure that the rod 26 operates as a solid rod during normal operating, and a spring loaded rod during testing.

The improved throw rod described herein allows for normal operation, with spring loaded operation only when desired. This is normally desired only during testing, but special circumstances could indicate spring loaded operation during other situations. Because spring loaded operation is selectable, flexibility is available.

The spring loaded operation of the rod allows testing to be performed without undue stresses and damage to the switch. This can extend the operating life of a switch, and avoid the need for expensive repairs. The improved throw rod can be installed in any existing switch by simply retrofitting the rod, so that the advantages of the invention can be easily realized in existing switches.

While the invention has been particularly shown and described with reference to a preferred embodiment, it will be understood by those skilled in the art that various changes in form and detail may be made therein without departing from the spirit and scope of the invention.

What is claimed is:

1. An improved throw rod for a rail switch, comprising:

a first elongate rod portion;

a second elongate rod portion;

a cylinder connected to the first rod portion;

a piston connected to the second rod portion, wherein the piston is slidably mounted within the cylinder;

an externally removable restraining mechanism being in contact with the piston and cylinder to prevent movement of the piston within the cylinder along a longitudinal axis of the cylinder; and at least one spring within the cylinder and connected to the piston, wherein movement of the piston within the cylinder is limited when the restraining mechanism is removed.

2. The throw rod of claim 1, wherein the restraining mechanism comprises a pin extending through a wall of the cylinder and through the piston.

3. The throw rod of claim 1, wherein the cylinder contains two springs, one at each end of the piston.

4. A spring loaded throw rod assembly for use in a railway switch comprising:

a piston slidably disposed within sidewalls of a cylinder;

a spring disposed between an endwall of the piston and an endwall of the cylinder for applying a force against the piston during movement of the piston along a longitudinal axis of the cylinder during testing of the railway switch;

a first rod portion attached to the piston;

a second rod portion attached to the cylinder; and a pin being in contact with the piston and the cylinder, and substantially holding the piston at a selected position within the cylinder during normal operation of the railway switch and externally removable during testing of the railway switch.

5. The spring loaded throw rod assembly of claim 4, further comprising another spring disposed between another endwall of the piston and another endwall of the cylinder.

6. The spring loaded throw rod assembly of claim 4, wherein an end of the first rod portion is adapted for connection to a basket of the railway switch.

7. The spring loaded throw rod assembly of claim 4, wherein an end of the second rod portion is adapted for connection to a switch machine.

8. A railway switch assembly comprising:

a switch machine;

a basket; and a throw rod assembly comprising:

a piston slidably disposed within sidewalls of a cylinder;

a spring disposed within the cylinder for applying a force against the piston during movement of the piston along a longitudinal axis of the cylinder;

a first rod portion attached to the piston and the basket;

a second rod portion attached to the cylinder and the switch machine; and an externally removable restraining mechanism being in contact with the piston and the cylinder for substantially holding the piston at a selected position.

9. The switch assembly of claim 8, wherein the restraining mechanism comprises a substantially elongated pin adapted to extend through a portion of the cylinder.

10. The switch assembly of claim 8, wherein the spring comprises a selected one of a pair of springs for applying forces to opposing ends of the piston.

* * * * *